US010792954B2

(12) United States Patent
Jones

(10) Patent No.: US 10,792,954 B2
(45) Date of Patent: Oct. 6, 2020

(54) PORTABLE MOTORIZED COSMETIC SHARPENER SYSTEM

(71) Applicant: SI/TKO Holdings, Inc., Odessa, FL (US)

(72) Inventor: Ryan Christopher Jones, Dunedin, FL (US)

(73) Assignee: SI/TKO Holdings, Inc., Odessa, FL (US)

( * ) Notice: Subject to any disclaimer, the term of this patent is extended or adjusted under 35 U.S.C. 154(b) by 0 days.

(21) Appl. No.: 15/238,602

(22) Filed: Aug. 16, 2016

(65) Prior Publication Data

US 2017/0050462 A1 Feb. 23, 2017

Related U.S. Application Data

(60) Provisional application No. 62/206,744, filed on Aug. 18, 2015.

(51) Int. Cl.
*B43L 23/08* (2006.01)
*A45D 40/20* (2006.01)

(52) U.S. Cl.
CPC ..... *B43L 23/08* (2013.01); *A45D 40/20* (2013.01); *A45D 2040/202* (2013.01)

(58) Field of Classification Search
CPC ..... B43L 23/004; B43L 23/008; B43L 23/02; B43L 23/08; B43L 23/00; B43L 23/06
See application file for complete search history.

(56) References Cited

U.S. PATENT DOCUMENTS

| | | | | | |
|---|---|---|---|---|---|
| 2,563,015 | A * | 8/1951 | Ewald | B43L 23/08 | 30/461 |
| 3,097,629 | A * | 7/1963 | Fleming | B43L 23/08 | 30/454 |
| 3,424,210 | A * | 1/1969 | Dziuk Peter | B43L 23/02 | 144/28.72 |
| 3,595,285 | A * | 7/1971 | Ruben | B43L 23/02 | 144/28.5 |
| 3,650,308 | A * | 3/1972 | Hori | B43L 23/02 | 144/28.5 |
| 3,776,286 | A * | 12/1973 | Blanck | B43L 23/02 | 144/28.5 |
| 7,472,728 | B1 * | 1/2009 | Geffen | B43L 23/008 | 144/28.5 |
| 2004/0016476 | A1 * | 1/2004 | Lamers | B43L 23/02 | 144/28.6 |
| 2008/0022538 | A1 * | 1/2008 | Parrish | B43L 23/02 | 30/457 |
| 2008/0120848 | A1 * | 5/2008 | Fong | B43L 23/004 | 30/454 |
| 2009/0211666 | A1 * | 8/2009 | Sued | B43L 23/00 | 144/360 |

* cited by examiner

*Primary Examiner* — David P Angwin
*Assistant Examiner* — Bradley S Oliver
(74) *Attorney, Agent, or Firm* — Smith & Hopen, P.A.; Paul Murty

(57) ABSTRACT

A housing is formed with an opening for the receipt of a cosmetic pencil to be sharpened. A shaping funnel within the housing is formed of a plurality blades in operative proximity around the opening. A motor rotates the shaping funnel and the plurality of blades for sharpening the cosmetic pencil within the shaping funnel.

2 Claims, 4 Drawing Sheets

FIG. 5
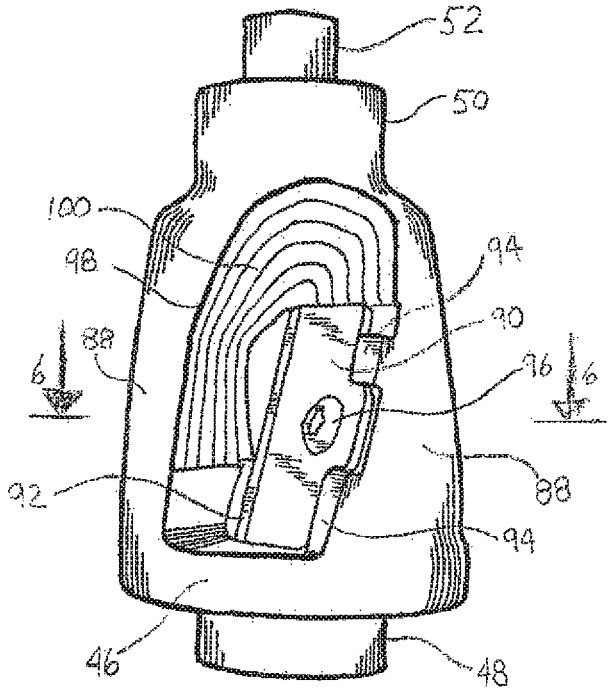
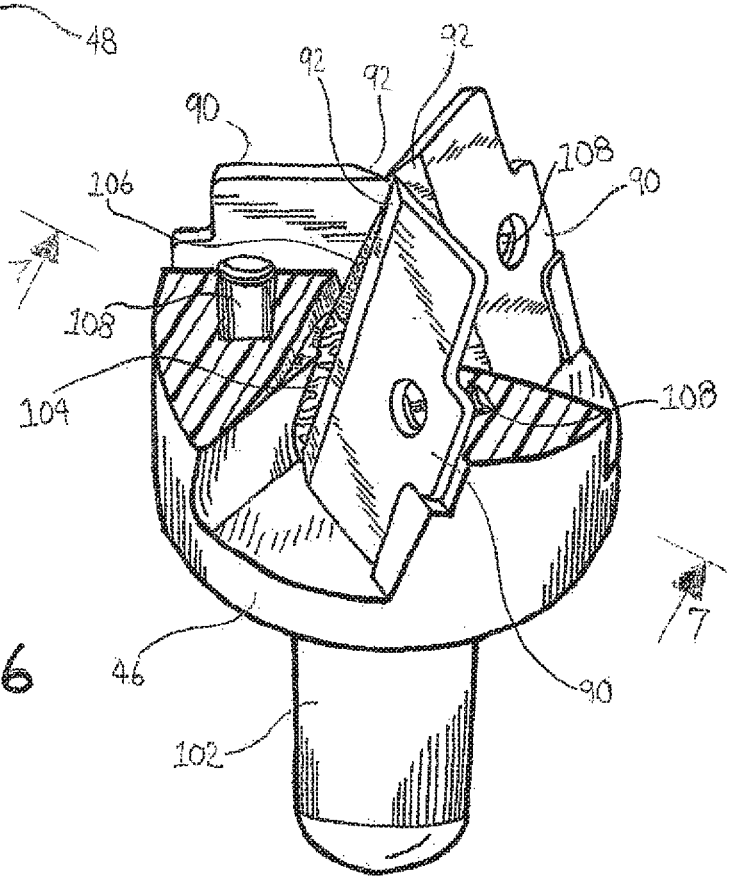
FIG. 6

PORTABLE MOTORIZED COSMETIC SHARPENER SYSTEM

RELATED APPLICATION

This application is based upon and claims the benefit of Provisional Application No. 62/206,744 filed Aug. 18, 2015, entitled "Portable Motorized Cosmetic Sharpener System", the subject matter of which application is incorporated herein by reference.

BACKGROUND OF THE INVENTION

Field of the Invention

The present invention relates to a portable motorized cosmetic sharpener system and more particularly pertains to incorporating an assembly of multiple rotating sharpening blades into a portable rechargeable battery powered device to provide the service of efficiently sharpening cosmetic pencils.

Description of the Prior Art

The use of cosmetic pencil sharpeners is known in the prior art. More specifically, cosmetic pencil sharpeners previously devised and utilized for the purpose of manually sharpening cosmetic pencil material providing a single sharp blade to shape a desired radius point for applying cosmetic pencil material are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a portable motorized cosmetic sharpener system that allows incorporating a system of rotating sharpening blades into a portable battery powered handheld device, the incorporating being done in a safe, convenient, simple, and economical manner.

In this respect, the portable motorized cosmetic sharpener system according to the present invention substantially departs from the conventional concepts and designs of the prior art, and in doing so provides an apparatus primarily developed for the purpose of incorporating a system of rotating sharpening blades into a portable battery powered handheld device, the incorporating being done in a safe, convenient, simple, and economical manner.

Therefore, it can be appreciated that there exists a continuing need for a new and improved portable motorized cosmetic sharpener system which can be used for incorporating a system of rotating sharpening blades into a portable battery powered handheld device, the incorporating being done in a safe, convenient, simple, and economical manner. In this regard, the present invention substantially fulfills this need.

SUMMARY OF THE INVENTION

In view of the disadvantages inherent in the known types of single blade cosmetic pencil sharpeners now present in the prior art, the present invention provides an improved portable motorized cosmetic sharpener system that provides the shaping of a desired radius point to apply cosmetic materials capabilities.

As such, the general purpose of the present invention, which will be described subsequently in greater detail, is to provide a new and improved portable motorized cosmetic sharpener system and method which has all the advantages of the prior art and none of the disadvantages.

To attain this, the portable motorized cosmetic sharpener system is comprised of a plurality of components. In their broadest context such include a housing formed with an opening for the receipt of a cosmetic pencil to be sharpened, a shaping funnel within the housing formed of a plurality blades in operative proximity around the opening, and a motor to rotate the shaping funnel and the plurality of blades for sharpening the cosmetic pencil within the shaping funnel. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable motorized cosmetic sharpener system which has all of the advantages of the prior art cosmetic sharpener systems and none of the disadvantages.

It is another object of the present invention to provide a new and improved portable motorized cosmetic sharpener system which may be easily and efficiently manufactured and marketed.

It is a further object of the present invention to provide a new and improved portable motorized cosmetic sharpener system which is of durable and reliable constructions.

An even further object of the present invention is to provide a new and improved portable motorized cosmetic sharpener system which is susceptible of a low cost of manufacture with regard to both materials and labor, and which accordingly is then susceptible of low prices of sale to the consuming public, thereby making such portable motorized cosmetic sharpener system economically available to the buying public.

Lastly, it is an object of the present invention to provide a portable motorized cosmetic sharpener system for incorporating a system of rotating sharpening blades into a portable battery powered handheld device, the incorporating being done in a safe, convenient, simple, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings of primary and alternate embodiments of the invention wherein:

FIG. 5 is an exploded side elevational view of the shaping cone assembly taken along line 5-5 of FIG. 3.

FIG. 6 is an alternate exploded cross sectional perspective illustration of the portable sharpener shaping cone assembly taken along line 6-6 of FIG. 5 illustrating the shaping of cosmetic pencil material.

The same reference numerals refer to the same parts throughout the various Figures.

DESCRIPTION OF THE PREFERRED EMBODIMENT

Figure 1:
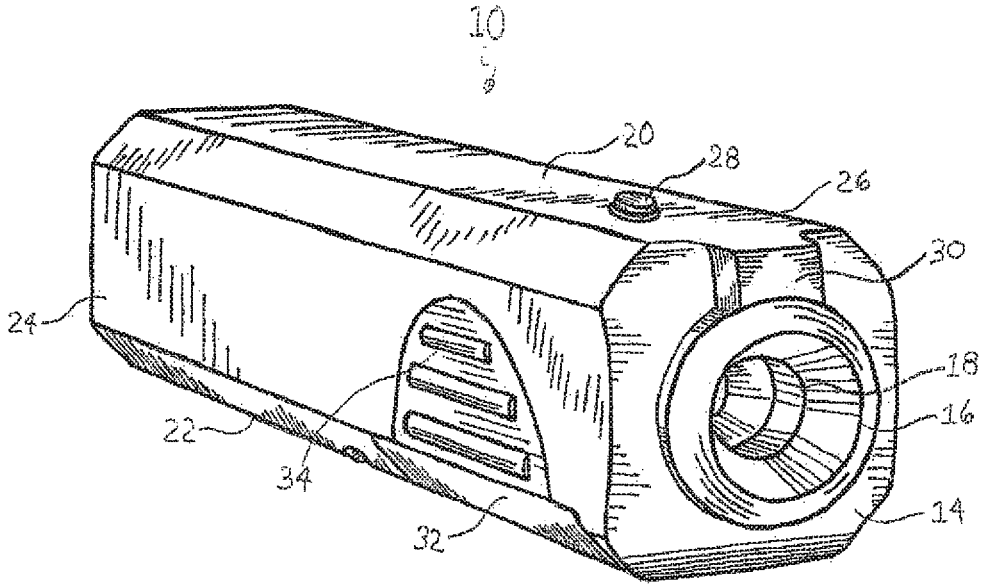
FIG. 1 is a perspective illustration of a portable motorized cosmetic sharpener system housing assembly constructed in accordance with the principles of the present invention.

With reference now to the drawings, and in particular to FIG. 1 thereof, the preferred embodiment of the new and improved portable motorized cosmetic sharpener system embodying the principles and concepts of the present invention and generally designated by the reference numeral 10 will be described.

The present invention, the portable motorized cosmetic sharpener system 10 is comprised of a plurality of components. Such components in their broadest context include a housing, a shaping funnel, and a motor. Such components are individually configured and correlated with respect to each other so as to attain the desired objective.

From a specific standpoint, in the preferred embodiment of the invention, first provided is a housing. The housing has a generally rectilinear configuration with a front plate and a parallel rear plate, an upper section and a parallel lower section, and a left section and a parallel right section. The housing is hollow with a front internal chamber and a rear internal chamber. A cylindrical opening in the front plate extends into the front internal chamber. The cylindrical opening and the front internal chamber have a central axis.

Next provided is a shaping cone assembly. The shaping cone assembly is formed of a front cylindrical plate and a rear cylindrical plate and three blades supported by the front and rear cylindrical plates. The three blades are circumferentially spaced around the central axis. The shaping cone assembly has a blade axis coincident with the central axis. The blades form an acute angle with respect to the blade axis. The shaping cone is positioned in the front internal chamber. The shaping cone assembly has a rotary gear extending into the rear internal chamber.

A motor is next provided. The motor is located in the rear internal chamber. The motor has a drive shaft coupled to the rotary gear for rotating the shaping cone assembly.

Next, a cosmetic pencil is removably positioned into the front plate and the shaping cone assembly. In this manner powering the motor will rotate the shaping cone assembly and trim debris from the cosmetic pencil.

A receptacle tray is next provided. The receptacle tray partially surrounds the shaping cone assembly. The receptacle tray collects debris from the sharpened cosmetic pencil.

Lastly, in the preferred embodiment, a control assembly is provided. The control assembly includes a sensor coupled with respect to the opening. In this manner inserting a cosmetic pencil into the front opening will energize the motor and rotate the shaping cone assembly. The control assembly includes a rechargeable battery for powering the shaping cone assembly. The control assembly also includes a control knob on the upper section of the housing to vary the speed of rotation of the shaping cone assembly.

FIGS. 1-4 illustrate the preferred embodiment of the portable motorized cosmetic sharpener system, designated by reference numeral 10. The portable motorized cosmetic sharpener system 10 is for shaping cosmetic material pencils through the front section cylindrical opening utilizing the internal rotating shaping cone assembly to increase the cosmetic pencil material shaping effectiveness of the system.

First provided is a cosmetic pencil. A cosmetic pencil has an outer cylindrical casing approximately five sixteenths of an inch in diameter of hard material. The pencil outer casing has an inner core of soft wax-like colored material approximately one eighth inch diameter.

Next is a cosmetic pencil sharpener. A cosmetic pencil sharpener has a single sharp edge blade. The blade is typically positioned at a fixed angle to shape the desired cosmetic pencil tip material radius. Rotating a cosmetic pencil at the approximate angle against the sharp blade progressively removes material simultaneously from the hard outer casing and inner wax-like core to form a shaped radius of cosmetic material on the pencil end tip for desired material application.

Lastly provided is the portable sharpener system outer plastic housing assembly. The sharpener outer housing assembly has a front region and a rear region. The front and rear region is formed with horizontal upper, lower and side parallel sections.

The front region of the housing assembly has a configured front plate 14. The front plate has an outer cylindrical opening 16 that reduces to an inner radius of approximately five sixteenths of an inch 18 to allow insertion of a cosmetic pencil end into the rotating sharpening system. The housing assembly has an upper section 20 that extends parallel to the housing assembly lower section 22. The housing assembly has a left section 24 that extends parallel to the housing assembly right section 26. The upper section 20 has a control knob 28 and forward section 30 that extends to the front plate 14 to turn on and off the rotating electrical system components. The front region has a lower shaped material receptacle tray 32 to collect shaped cosmetic pencil material waste. The lower shaped material receptacle tray has opposing left and right tray release levers 34 to remove the lower receptacle tray from the housing assembly to empty shaped cosmetic pencil material waste.

Figure 2:
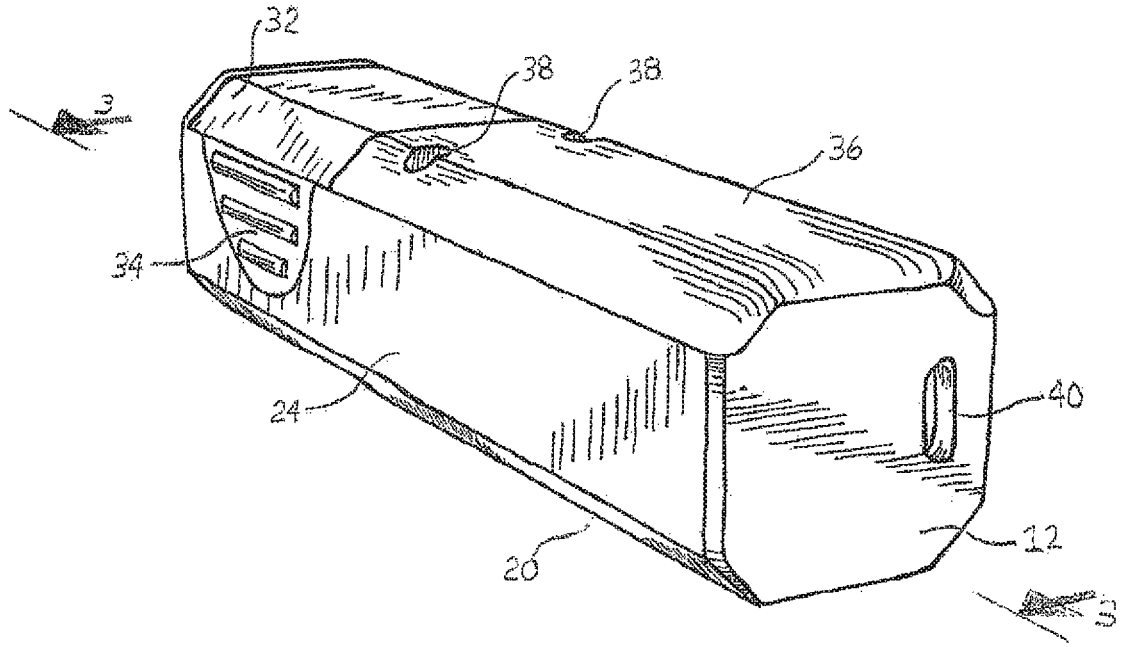
FIG. 2 is a rear perspective illustration of the portable sharpener system housing assembly lower section shown in FIG. 1.

As shown in FIG. 2, the housing assembly lower section has a rear cover 36 with securing hardware holes 38. The housing assembly rear region has a configured rear plate 12 and a battery charging connector 40 to recharge the internal chamber system battery 62.

Figure 3:
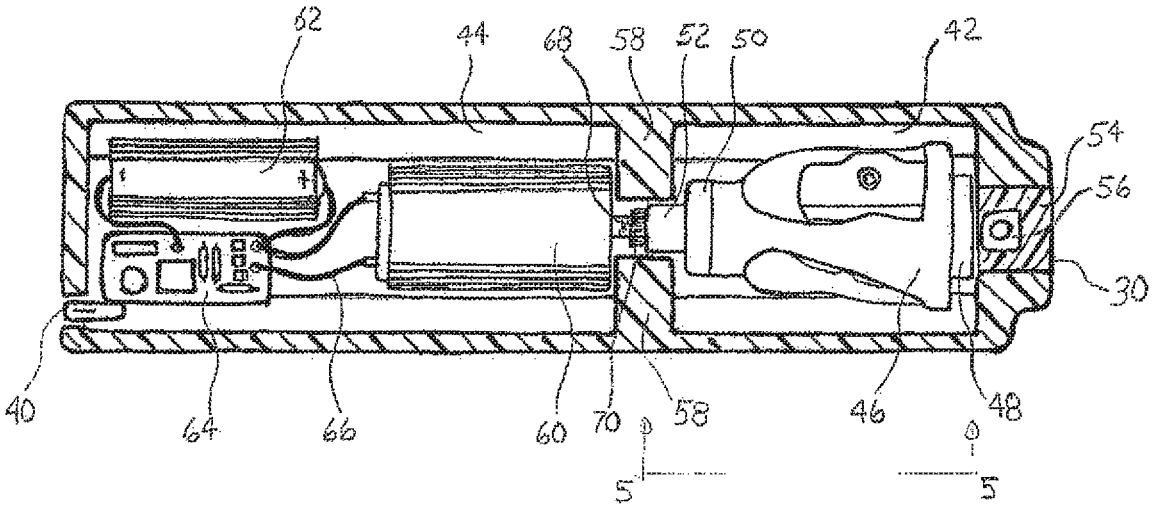
FIG. 3 is a cross sectional view of the portable sharpener system housing assembly taken along line 3-3 of FIG. 2.

FIG. 3 illustrates the internal components taken along line 3-3 of FIG. 2. The interior housing assembly encompasses a front internal chamber 42 for shaping a cosmetic pencil and a rear internal chamber 44 for securing the system rotating electrical components. The front internal chamber encompasses a shaping cone system 46. The shaping cone system has a front cylindrical plate 48, a rear cylindrical plate 50 and a rear plate rotating gear 52. The shaping cone system is illustrated in further detail in FIGS. 5, 6 and 7. The front forward section 30 has an internal chamber 54 that encompasses an alternate automatic on and off sensor 56 to control the rotating electrical system components. The front chamber and the rear chamber are separated by a chamber wall section 58. The rear chamber encompasses a rotating assembly drive motor 60, a rechargeable electric system battery 62, a power circuit board 64, a battery recharging connector 40 and electronic component system wiring 66. The rotating drive motor 60 has a drive shaft 68 and a drive shaft gear 70.

Figure 4:
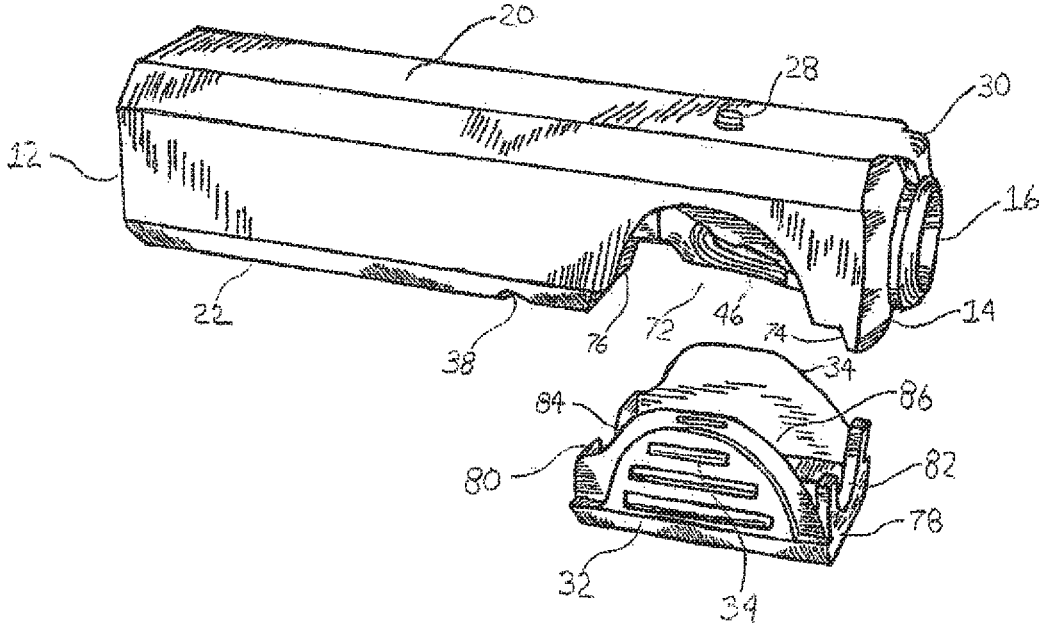
FIG. 4 is a side perspective illustration of the portable sharpener system housing with a perspective view of the lower receptacle tray removed from the housing insertion area.

FIG. 4 illustrates the front region lower receptacle tray 32. The front region and front chamber has a receptacle insertion area 72. The receptacle insertion area has a front vertical section 74 and a rear vertical section 76. The lower receptacle tray has a front section 78 and a rear section 80 that insert parallel to the front vertical section 74 and rear vertical section 76. The front tray section 78 has a radius 82 that inserts around the front cylindrical plate 48. The rear tray section 80 has a radius 84 that inserts around the rear cylindrical plate 52. The shaped cosmetic materials are collected in the lower receptacle tray chamber 86.

As seen in FIG. 5, the shaping cone system 46 has a front cylindrical plate 48 and a rear cylindrical plate 50. The shaping cone system encompasses multiple supports 88 that secure shaping system blades 90. The shaping blades have a sharp edge 92 to shape cosmetic pencil material. The shaping blades 90 are aligned by upper and lower support tabs 94 and secured to the supports 88 with mounting hardware 96 at an approximate 18 degree angle for efficient cosmetic pencil sharpening. The supports have a rear vertical side 98 with a curved upper section 100 to guide the shaped material away from the shaping blades. The supports 88 alternatively can be incorporated with abrasive materials to aid the blades for optimum cosmetic pencil sharpening.

FIG. 6 illustrates the insertion of a cosmetic pencil 102 into the shaping cone system 46. The cosmetic pencil has an outer hard casing 104 and a soft wax-like inner core 106. Each support 88 has a securing hole 108 to insert the mounting hardware 96. The shaping blades sharp edge 92 is positioned at an approximate 18 degree angle to shape the outer hard casing and the wax-like inner core.

Figure 7:
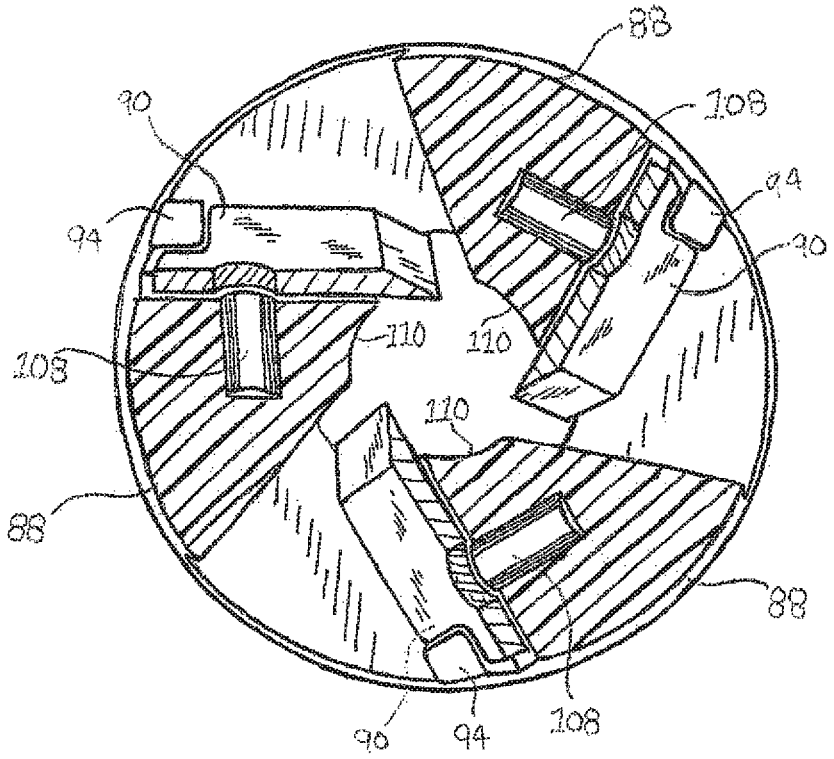
FIG. 7 is a cross sectional view of the portable sharpener shaping cone assembly taken along line 7-7 of FIG. 6.

As seen in FIG. 7, which is an elevated cross sectional view taken along lines 7-7 of FIG. 6, the shaping supports 88 have an inner angled radius 110. The inner radius guides the cosmetic pencil outer casing 104 as the shaping cone system 46 rotates around the cosmetic pencil.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable motorized cosmetic sharpener system comprising:

a housing formed with an opening for the receipt of a cosmetic pencil to be sharpened, the opening defining a central axis along a longitudinal length of the housing, the housing including a top surface opposite a bottom surface and a plurality of side surfaces joining the top surface to the bottom surface, with an aperture defined by a portion of the bottom surface and the plurality of side surfaces, the aperture forming a channel to an internal portion of the housing;

a shaping funnel fixedly secured to the internal portion of the housing, the shaping funnel formed of a plurality of supports that secure a plurality blades in operative proximity around the opening, each of the plurality of supports including a rear vertical side including a curved upper section configured to guide shaped material waste away from the plurality of blades and toward the bottom surface of the housing, each of the plurality of blades being circumferentially spaced around the central axis, with the shaping funnel defining a blade axis coincident with the central axis, each of the plurality of blades forming an acute angle with respect to the blade axis and each of the plurality of blades terminating in a sharp edge that is oriented at a fixed angle with respect to a plane defined by an associated blade via an upper support tab, a lower support tab, and mounting hardware, such that a plane defined by the sharp edge intersects with the plane defined by the associated blade, the upper support tab, the lower support tab, and the mounting hardware secured to the plurality of supports; and a receptacle tray removably secured to the housing, the receptacle tray including a bottom surface and two opposing sidewalls extending away from the bottom surface, such that the receptacle tray surmounts the aperture defined by the portion of the bottom surface and the plurality of side surfaces, the receptacle tray configured to collect shaped material waste from the cosmetic pencil therein;

a motor to rotate the shaping funnel and the plurality of blades for sharpening the cosmetic pencil within the shaping funnel, wherein a rotation of the shaping funnel results in the shaped material waste being guided, via each curved upper section of the plurality of supports, away from the plurality of blades and toward the bottom surface of the housing.

2. A portable motorized cosmetic sharpener system for trimming a cosmetic pencil and collecting the trimmed debris, the trimming and the collecting being done in a safe, convenient, and economical manner, the system comprising, in combination:

a housing having a generally rectilinear configuration with a front plate and a parallel rear plate, an upper section and a parallel lower section, and a left section and a parallel right section, the housing being hollow with a front internal chamber and a rear internal chamber, a cylindrical opening in the front plate extending into the front internal chamber, the cylindrical opening and the front internal chamber having a central axis, with an aperture defined by a portion of the lower surface, a portion of the left section, and a portion of the right section, the aperture forming a channel to the front internal chamber of the housing;

a shaping cone assembly formed of a front cylindrical plate and a rear cylindrical plate with a plurality of supports disposed between the front cylindrical plate and the rear cylindrical plate, each of the plurality of supports including a rear vertical side including a curved upper section configured to guide shaped material waste away from the plurality of blades and toward the lower surface of the housing, the plurality of supports together securing three blades to the front and rear cylindrical plates, the three blades being circumferentially spaced around the central axis, the shaping cone having a blade axis coincident with the central axis, each of the three blades forming a fixed acute angle with respect to the blade axis via an upper support tab, a lower support tab, and mounting hardware, the upper support tab, the lower support tab, and the mounting hardware secured to the plurality of supports, and each of the three blades terminating in a sharp edge that is oriented at an angle with respect to a plane defined by an associated blade, such that a plane defined by the sharp edge intersects with the plane defined by the associated blade, the shaping cone being fixedly positioned in the front internal chamber, the shaping cone having a rotary gear extending into the rear internal chamber;

a receptacle tray removably secured to the housing, the receptacle tray including a bottom surface and two opposing sidewalls extending away from the bottom surface, such that the receptacle tray surmounts the aperture defined by the portion of the lower surface, the portion of the left section, and the portion of the right section, the receptacle tray configured to collect shaped material waste from the cosmetic pencil therein, a motor located in the rear internal chamber, the motor having a drive shaft coupled to the rotary gear for rotating the shaping cone assembly;

a cosmetic pencil removably positioned into the front plate and the shaping cone assembly whereby powering the motor will rotate the shaping cone assembly and trim shaped material waste from the cosmetic pencil; and a control assembly including a sensor coupled with respect to the cylindrical opening whereby inserting a cosmetic pencil into the front opening will energize the motor and rotate the shaping cone assembly, the control assembly including a rechargeable battery for powering the shaping cone assembly, the control assembly also including a control knob on the upper section of the housing to vary the speed of rotation of the shaping cone assembly.

* * * * *